US005253017A

United States Patent [19]

Takeda

[11] Patent Number: 5,253,017

[45] Date of Patent: Oct. 12, 1993

[54] IMAGE FORMING APPARATUS

[75] Inventor: Fuchio Takeda, Tokyo, Japan

[73] Assignee: Ricoh Company, Ltd., Tokyo, Japan

[21] Appl. No.: 976,424

[22] Filed: Nov. 13, 1992

[30] Foreign Application Priority Data

Nov. 13, 1991 [JP] Japan ..... 3-297382

[51] Int. Cl.[5] ..... G03G 15/02; G03G 21/00

[52] U.S. Cl. ..... 355/219; 355/214; 355/246; 361/225; 361/230; 361/235

[58] Field of Search ..... 355/214, 219, 221, 246; 361/225, 230, 235, 221

[56] References Cited

U.S. PATENT DOCUMENTS 3,961,193 6/1976 Hudson ..... 361/235 X
4,484,812 11/1984 Takayanagi ..... 361/235 X
5,060,017 10/1991 Ueda ..... 355/219 X
5,144,368 9/1992 Ohzeki et al. ..... 355/219

FOREIGN PATENT DOCUMENTS 0225864 11/1985 Japan ..... 355/219
0067175 3/1992 Japan ..... 355/219

*Primary Examiner*—A. T. Grimley
*Assistant Examiner*—Matthew S. Smith
*Attorney, Agent, or Firm*—Oblon, Spivak, McClelland, Maier & Neustadt

[57] ABSTRACT

An image forming apparatus capable of preventing a toner from depositing on non-charged part of an image carrier just after the start of an image forming operation even when implemented with a contact reversal development system and a contact charging system. A charge power source assigned to a charging roller feeds a current great enough to prevent toner deposition on the non-charged part of the image carrier to a constant voltage generation circuit which is connected to the image carrier.

3 Claims, 3 Drawing Sheets

IMAGE FORMING APPARATUS

BACKGROUND OF THE INVENTION

The present invention relates to a copier, facsimile transceiver or similar image forming apparatus and, more particularly, to a charging arrangement capable of preventing a toner from depositing on non-charged part of an image carrier at the start of an image forming operation.

An electrophotographic image forming apparatus, e.g., an electrophotographic copier charges the surface of a photoconductive element or similar image carrier by a charging unit, exposes the charged surface of the image carrier to imagewise light to form an electrostatic latent image, and develops the latent image by a developer, e.g., a toner stored in a developing unit to form a toner image. The problem with this type of apparatus is that at least part of the surface of the image carrier between the charging unit and the developing unit is not charged just after the start of an image forming operation. When such part of the image carrier passes the developing unit, the toner stored in the developing unit unavoidably deposits on the non-charged part even if a bias for development has been switched to zero beforehand. The toner on the drum is apt to increase the load on a cleaning unit to thereby reduce its life. To eliminate this problem, it is a common practice to connect a constant voltage generation circuit constituted by a Zener diode and a capacitor to the casing of the charging unit via a varistor and to connect the image carrier to ground via the Zener diode. In this configuration, simultaneously with the start of an image forming operation, the constant voltage generation circuit causes a current to flow through the image carrier. As a result, the image carrier is biased to prevent the toner from undesirably depositing thereon.

On the other hand, a contact charging system is known in the art which connects a charging roller to a charge power source and holds it in contact with the image carrier. This kind of scheme noticeably reduces the current required to flow through the image carrier via the charging roller. However, since the image carrier is simply connected to ground via the Zener diode, the current is too small to generate a Zener voltage. Hence, it is difficult to develop an electric field intense enough to eliminate the toner deposition stated above.

SUMMARY OF THE INVENTION

It is, therefore, an object of the present invention to provide an image forming apparatus capable of preventing a toner from undesirably depositing on non-charge part of an image carrier just after the start of an image forming operation even when a contact reversal development system and a contact charging system are used.

An image forming apparatus of the present invention comprises a movable image carrier for forming a latent image thereon, a charging unit comprising a charging roller for charging the image carrier in contact with the image carrier, and a charge power source for contact charging, a developing unit for developing the latent image formed on the image carrier by contact reverse development, and a constant voltage generation circuit connected to the image carrier and ground and supplied with a current from the charge power source of the charging unit.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
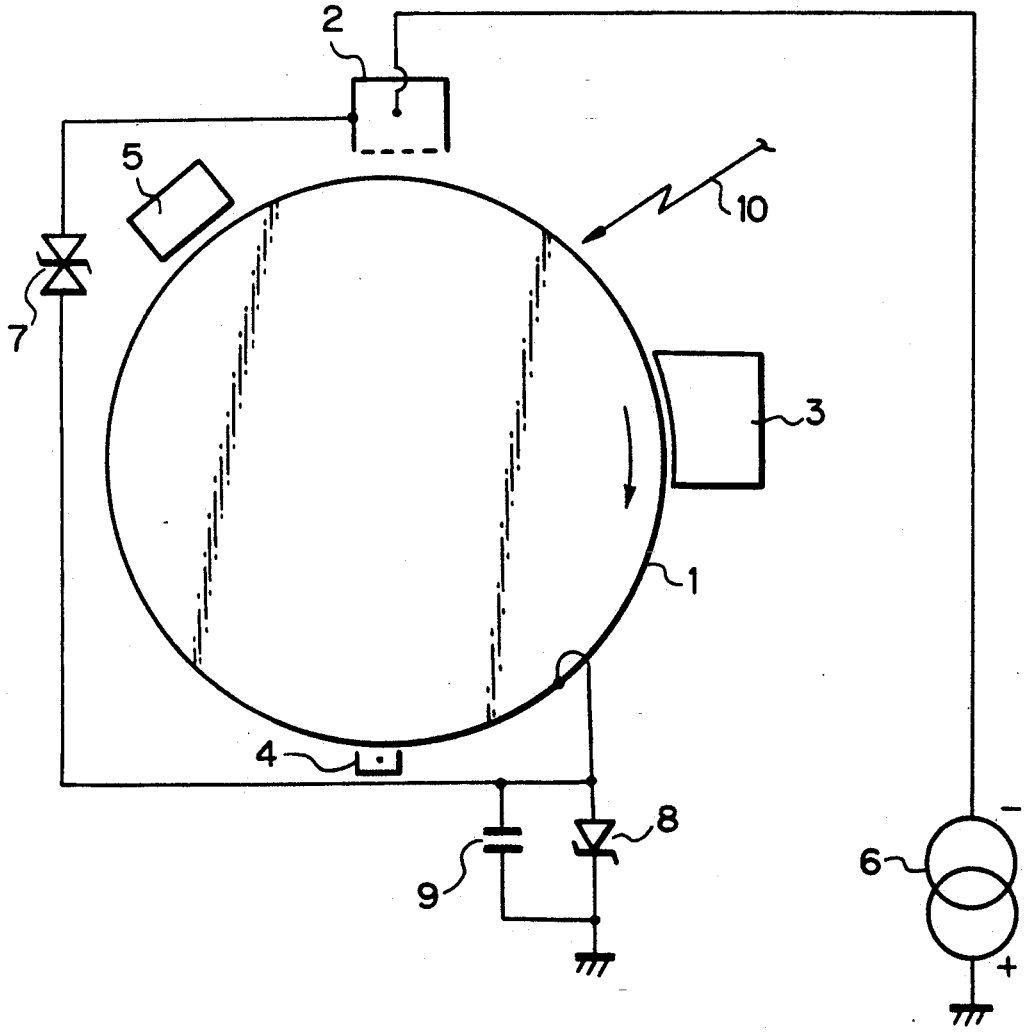
Fig. 1 PRIOR ART
FIG. 1 is a section showing a conventional image forming apparatus.

To better understand the present invention, a brief reference will be made to a conventional image forming apparatus, shown in FIG. 1. As shown, the image forming apparatus has a photoconductive element in the form of a drum 1. Arranged around the drum 1 are a charging unit 2 connected to a charge power source 6, a developing unit 3, an image transfer unit 4, and a cleaning unit 5. To form an image, while the drum 1 is rotated, it is charged to, for example, negative polarity by the charging unit 2. Light 10 for writing an image is incident on the charged surface of the drum 1. The problem with this scheme is that just after the start of an image forming operation part of the surface of the drum 1 intervening between the charging unit 2 and the developing unit 3 is not charged by the charging unit 2. As such a non-charged portion of the drum 1 passes the developing unit 3, a toner stored in the unit 3 unavoidably deposits on the non-charged portion even if a bias for development has been switched to zero beforehand. The toner on the drum 1 is apt to increase the load on the cleaning unit 5 to thereby reduce its life. To eliminate this problem, it is a common practice to connect a constant voltage generation circuit constituted by a Zener diode 8 and a capacitor 9 to the casing of the charging unit 2 via a varistor and to connect the drum 1 to ground via the Zener diode 8. Specifically, simultaneously with the start of an image forming operation, the constant voltage generation circuit causes a current to flow through the drum 1. As a result, the drum 1 is biased to prevent the toner from undesirably depositing thereon, thereby reducing the load on the cleaning unit 5.

Assume that the previously mentioned contact charging system is applied to the charging unit 2, i.e., a charging roller connected to a charge power source is held in contact with the drum 1. This kind of scheme noticeably reduces the current required to flow through the drum 1 via the charging roller. However, since the drum 1 is simply connected to ground via the Zener diode 8, the current is too small to generate a Zener voltage. Hence, it is difficult to develop an electric field intense enough to eliminate the toner deposition stated above.

Figure 2:
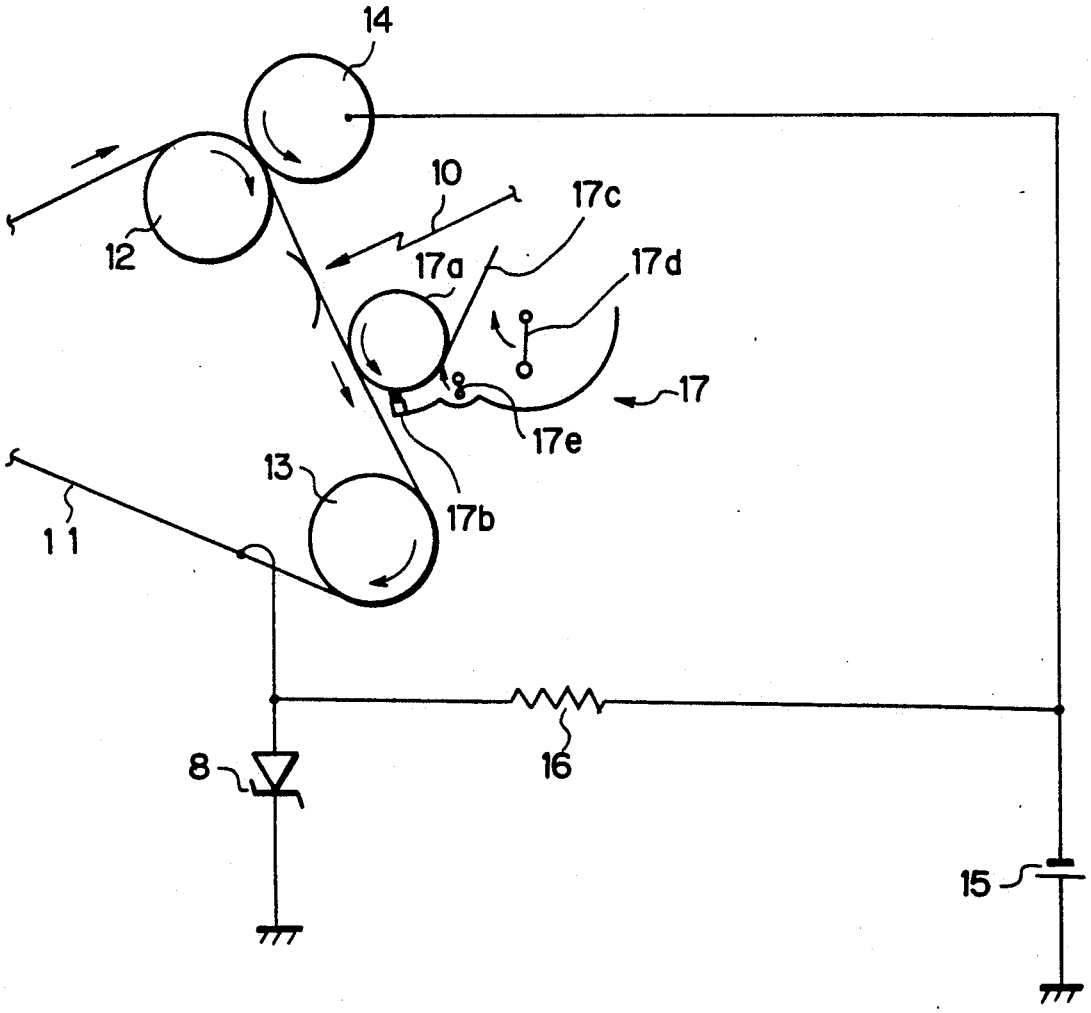
FIG. 2 is a section showing an image forming apparatus embodying the present invention.

Referring to FIG. 2, an image forming apparatus embodying the present invention is shown which is implemented with the contact charging system and a reversal developing system based on contact development. As shown, the image forming apparatus has a photoconductive element in the form of a belt 11 which is passed over rollers 12 and 13. A charging roller 14 charges the belt 11 to, for example, negative polarity and remains in pressing contact with the roller 12. The charging roller 14 is connected to a constant voltage power source 15 which plays the role of a charge power source. A Zener diode 8 is connected at one terminal thereof to ground and and is connected at the other terminal to a conductive substrate included in the belt 11 at a position downstream of the roller 13. The power source 15 and Zener diode 8 are connected together via a resistor 16. The resistance of the resistor 16 may be determined by dividing the difference between the power source voltage and the Zener voltage by the Zener current. Light 10 for writing an image is incident on part of the belt 11 intervening between the rollers 12 and 13. A reversal developing unit 17 using the contact developing system is located downstream of the light 10. The developing unit 17 is constituted by a developing roller 17*a* rotatable in contact with the belt 11, a discharging brush 17*b* contacting the developing roller 17*a*, a doctor brush 17 also contacting the roller 17*a*, and agitators 17*d* and 17*e* for supplying a toner to the roller 17*a* while agitating it.

In operation, simultaneously with the start of an image forming operation, the charge power source 15 is turned on. As a result, a current flows through the Zener diode 8 at the same time as the belt 11 starts moving. The current develops an electric field for preventing the toner from undesirably depositing on the non-charged portion of the belt 11. After the non-charged portion of the belt 11 has moved away from the developing unit 17, development is effected in a usual way.

Figure 3:
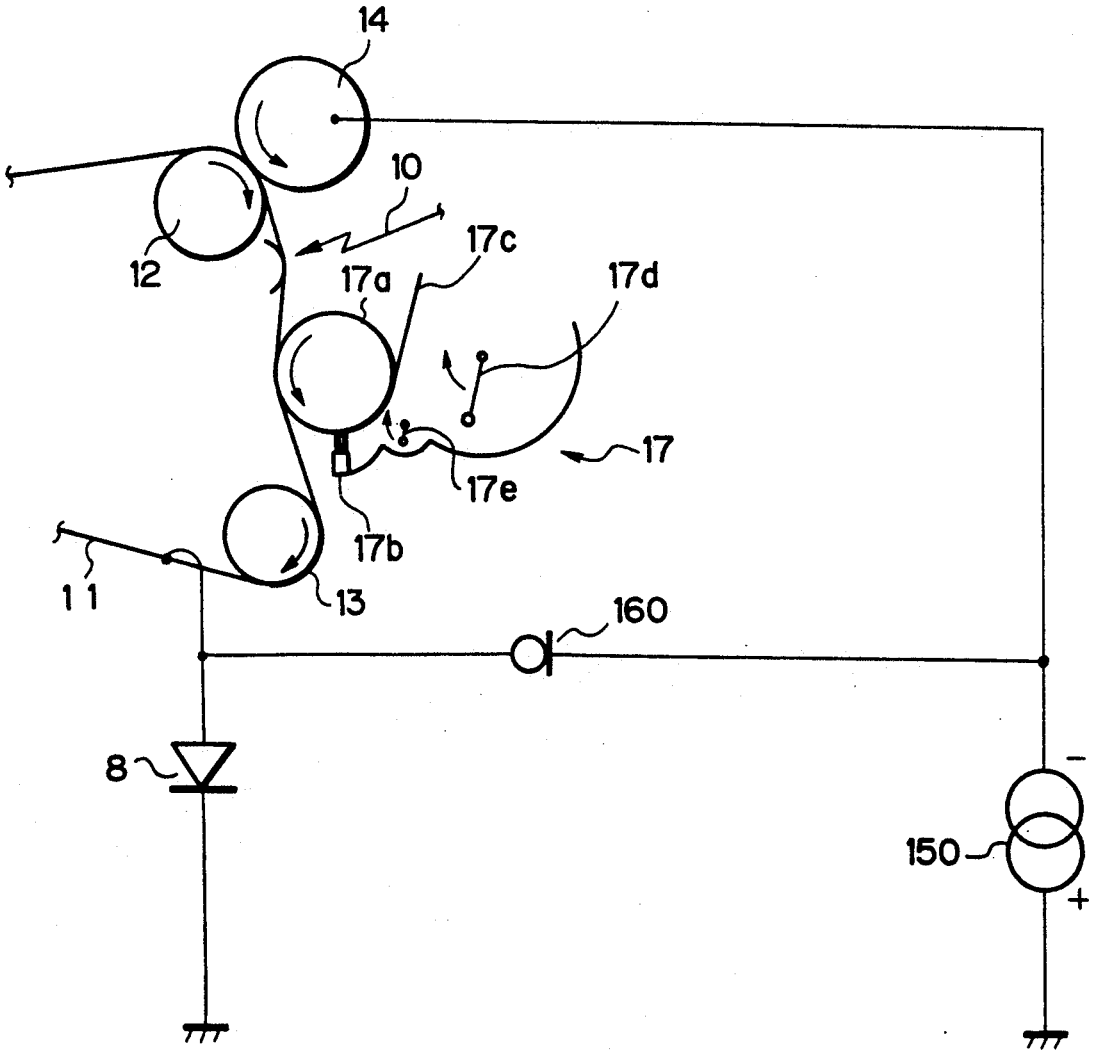
FIG. 3 is a section showing an alternative embodiment of the present invention.

FIG. 3 shows an alternative embodiment of the present invention. In this embodiment, a constant current power source 150 is used as the power source for contact charging. A constant current element 160 is connected to the power source 150 in place of the resistor 16 of the previous embodiment. The current of the constant current element 160 is selected to be greater than the operation current of the Zener diode 8. The constant current element 160 prevents most of the output current of the power source 150 from flowing into the Zener diode 8. Moreover, even when the output voltage of the power source 150 falls, the current to the Zener diode 8 is maintained constant over a broad range since the constant current element 160 lowers the internal resistance automatically. The output current of the power source 150 is set at the sum of the current to flow to the Zener diode 8 and the maximum current to flow to the charging roller 14. This is successful in eliminating a serious accident even if the circuitry shorts due to a defect which may occur in the charging roller 14 or in the belt 11.

While the constant current element 160 may be replaced with a high resistance for simplicity, a resistor often fails to cope with noticeable changes in the current to the charging roller 14.

In summary, it will be seen that the present invention provides an image forming apparatus capable of preventing a toner from undesirably depositing on non-charged part of an image carrier at the beginning of an image forming operation without resorting to a special switching unit or a synchronous independent power source unit. This unprecedented advantage is derived from a constant voltage generation circuit which is operated by a current from a power source associated with a charging roller.

Various modifications will become possible for those skilled in the art after receiving the teachings of the present disclosure without departing from the scope thereof. For example, in the embodiments, a capacitor may, of course, be connected in parallel with the constant voltage generation circuit including the Zener diode 8. Then, development will be also prevented when the image carrier is moved due to inertia when the apparatus stops operating.

What is claimed is:

1. An image forming apparatus comprising:

a movable image carrier for forming a latent image thereon;

a charging unit comprising a charging roller for charging said image carrier in contact with said image carrier, and a charge power source for contact charging;

a developing unit for developing the latent image formed on said image carrier by contact reverse development; and a constant voltage generation circuit connected to said image carrier and ground and supplied with a current from said charge power source of said charging unit.

2. An apparatus as claimed in claim 1, wherein said charge power source comprises a constant voltage power source which is connected to said constant voltage generation circuit via a resistor.

3. An apparatus as claimed in claim 1, wherein said charge power source comprises a constant current power source which is connected to said constant voltage generation circuit via a constant current circuit.

* * * * *